US011725793B2

(12) United States Patent
Qiu et al.

(10) Patent No.: US 11,725,793 B2
(45) Date of Patent: Aug. 15, 2023

(54) LENS FOR FORMING BEAM PATTERN IN LOW-BEAM ZONE III, VEHICLE ILLUMINATOR, AND AUTOMOBILE

(71) Applicant: HASCO VISION TECHNOLOGY CO., LTD., Shanghai (CN)

(72) Inventors: Zhiping Qiu, Shanghai (CN); He Zhu, Shanghai (CN); Cong Li, Shanghai (CN); Dapan Zhang, Shanghai (CN); Wenhui Sang, Shanghai (CN)

(73) Assignee: HASCO VISION TECHNOLOGY CO., LTD, Shanghai (CN)

( * ) Notice: Subject to any disclaimer, the term of this patent is extended or adjusted under 35 U.S.C. 154(b) by 33 days.

(21) Appl. No.: 17/611,039

(22) PCT Filed: Nov. 18, 2019

(86) PCT No.: PCT/CN2019/119177
§ 371 (c)(1),
(2) Date: Nov. 12, 2021

(87) PCT Pub. No.: WO2021/003946
PCT Pub. Date: Jan. 14, 2021

(65) Prior Publication Data

US 2022/0307667 A1 Sep. 29, 2022

(30) Foreign Application Priority Data

Jul. 11, 2019 (CN) ..... 201921096137.6
Sep. 27, 2019 (CN) ..... 201910927121.3

(51) Int. Cl.
*F21S 41/255* (2018.01)
*F21S 41/32* (2018.01)
(Continued)

(52) U.S. Cl.
CPC ..... *F21S 41/255* (2018.01); *F21S 41/275* (2018.01); *F21S 41/32* (2018.01); *F21W 2102/13* (2018.01)

(58) Field of Classification Search
CPC ..... F21S 41/275; F21S 41/25; F21V 5/004; F21V 5/005
See application file for complete search history.

(56) References Cited

U.S. PATENT DOCUMENTS 5,278,731 A 1/1994 Davenport et al.
10,161,617 B2 * 12/2018 Kanayama ..... F21V 29/763
(Continued)

FOREIGN PATENT DOCUMENTS

CN 106439672 A 2/2017
CN 206268977 U 6/2017
CN 108302479 A 7/2018

OTHER PUBLICATIONS

National Standard of the People's Republic of China, GB25991-2010, Issued Jan. 10, 2011, "Automotive headlamps with LED light sources and/or LED modules", General Administration of Quality Supervision, Inspection and Quarantine of the People's Republic of China; Standardization Administration of the People's Republic of China.

*Primary Examiner* — Robert J May
(74) *Attorney, Agent, or Firm* — Volpe Koenig

(57) ABSTRACT

A lens for forming a beam pattern in a low-beam zone III, a vehicle illuminator, and an automobile. The lens for forming the beam pattern in the low-beam zone III comprises a lens main body. A low-beam zone III formation structure is provided at or integrally formed with a light-entering surface of the lens main body. The low-beam zone III formation structure comprises multiple protrusions protruding from the light-entering surface and is used to diffuse light. The lens for forming the beam pattern in the low-beam
(Continued)

zone III has a simple structure, a small volume and high optical efficiency.

17 Claims, 14 Drawing Sheets

(51) Int. Cl.
*F21S 41/275* (2018.01)
*F21W 102/13* (2018.01)

(56) References Cited

U.S. PATENT DOCUMENTS

| | | | | |
|---|---|---|---|---|
| 10,359,167 | B2 * | 7/2019 | Iwasaki | F21S 41/43 |
| 10,670,214 | B2 * | 6/2020 | Nakazawa | B60Q 1/0035 |
| 2010/0124069 | A1 | 5/2010 | Nomura | |
| 2015/0292704 | A1 | 10/2015 | Koshiro | |

* cited by examiner

LENS FOR FORMING BEAM PATTERN IN LOW-BEAM ZONE III, VEHICLE ILLUMINATOR, AND AUTOMOBILE

CROSS REFERENCE TO RELATED APPLICATIONS

This application is a 35 USC § 371 National Stage application of International Patent Application No. PCT/CN2019/119177, which was filed Nov. 18, 2019, entitled "LENS FOR FORMING BEAM PATTERN IN LOW-BEAM ZONE III, VEHICLE ILLUMINATOR, AND AUTOMOBILE" and claims priority to Chinese Patent Application No. 201921096137.6, filed Jul. 11, 2019 and Chinese Patent Application No. 201910927121.3, filed Sep. 27, 2019 which are incorporated herein by reference as if fully set forth.

FIELD

The present disclosure relates to an automobile lamp, and particularly relates to a lens for forming a beam pattern in a low-beam zone III. In addition, the present disclosure also relates to a vehicle illuminator and an automobile.

BACKGROUND

An automobile lamp is an important part of an automobile and includes the following two types of lamps: a signal lamp which is mainly used for reminding pedestrians and other road users of the driving tendency of an automobile; and a lighting lamp which is mainly used for helping a driver see roads and obstacles clearly to effectively avoid colliding the obstacles. The lighting lamp includes a low beam light, a high beam light, a reading light, a reversing light, etc., wherein the low beam light is for short-distance lighting. According to relevant standards of the automobile lamp, e.g., Chinese standards GB25991, a low beam shape has an important part called "zone III" which is positioned above a cutoff line, and mainly plays a role in lighting objects such as signs above the road, so that the driver can acquire information of the signs and the like.

Most of existing automotive low-beam zone III forming structures are arranged on a lower surface of a condenser, light emitted from a light source is refracted by the zone III forming structure on the lower surface of the condenser, and then is emitted by a lens to form a beam pattern in a low-beam zone III conforming to regulatory requirements. However, with the increasingly higher requirements on diversity of automobile lamp module types, in order to meet different customer needs, the arrangement of parts in an automobile lamp module is different. If being arranged on the lower surface of the condenser, the low-beam zone III forming structure of the automobile is mostly likely to interfere with parts below the condenser, so as to affect the formation of the beam pattern in the low-beam zone III.

Based on the above reasons, it is difficult for the prior art to ensure that the formation of the beam pattern in the low-beam zone III is not affected in the case that the positions and quantity of the parts of the automobile lamp module are constantly changed.

SUMMARY

A first problem to be solved by the present disclosure is to provide a lens for forming a beam pattern in a low-beam zone III, and the lens can avoid interference of a formation structure of a beam pattern in a low-beam zone III with other parts in the case that the positions and quantity of parts in an automobile lamp module are constantly changed, and improve the flexibility of the arrangement of the parts in the automobile lamp module, and is simple in structure, convenient to process and stable in optical performance.

In addition, another problem to be solved by the present disclosure is to provide a vehicle illuminator, wherein a lens in the vehicle illuminator can avoid a formation structure of a beam pattern in a low-beam zone III with other parts in the case that the positions and quantity of parts in an automobile lamp module are constantly changed, and improve the flexibility of the arrangement of the parts in the automobile lamp module, and is simple in structure, convenient to process and stable in optical performance.

Further, a problem to be solved by the present disclosure is to provide an automobile, a vehicle illuminator of the automobile has a diversified structure, a beam pattern in a low-beam zone III is stable, and the optical efficiency is high.

In order to solve the above technical problems, in one aspect, the present disclosure provides a lens for forming a beam pattern in a low-beam zone III, which includes a lens main body, wherein a low-beam zone III formation structure is arranged or integrally formed on a light-entering surface of the lens main body and includes a plurality of multiple protrusions protruding from the light-entering surface for diffusing light.

As a preferential structural form of the present disclosure, the low-beam zone III formation structure includes a plurality of longitudinal strip-shaped multiple protrusions extending along an up-down direction of the lens main body.

Optionally, the low-beam zone III formation structure includes a plurality of horizontal strip-shaped multiple protrusions extending along a left-right direction of the lens main body.

Further optionally, the low-beam zone III formation structure includes a plurality of block-shaped multiple protrusions formed by connection of convex curved surfaces.

As another preferential structure form of the present disclosure, an upper and middle region of the light-entering surface of the lens main body is a plane in the up-down direction, a lower region of the light-entering surface of the lens main body is a plane inclining toward a light emitting direction from top to bottom, and a low beam zone III formation structure is arranged or integrally formed on the lower region of the light-entering surface.

As still another preferential structure form of the present disclosure, the low-beam zone III formation structure includes the plurality of longitudinal strip-shaped multiple protrusions arranged from a left side edge to a right side edge of the light-entering surface in sequence, the longitudinal strip-shaped multiple protrusions are connected to form a strip-shaped structure, and a longitudinal section line of a light-entering surface of each of the longitudinal strip-shaped multiple protrusions inclines toward the light emitting direction from top to bottom.

Optionally, the low-beam zone III formation structure includes a multiple protrusions structure formed by connection of the plurality of longitudinal strip-shaped multiple protrusions, the width of a horizontal section of each of the longitudinal strip-shaped multiple protrusions is gradually decreased from middle to two sides, and the longitudinal section line of the light-entering surface of each of the longitudinal strip-shaped multiple protrusions inclines toward the light emitting direction from top to bottom.

As a specific embodiment of the present disclosure, an outer edge of the horizontal section of each of the longitudinal strip-shaped multiple protrusions is a convex curve of which a central region is higher than two side regions, and an outer edge of a longitudinal section of each of the horizontal strip-shaped multiple protrusions is a convex curve of which a central region is higher than two side regions.

More specifically, the longitudinal strip-shaped multiple protrusions are equal in width, and the horizontal strip-shaped multiple protrusions are equal in width.

Further specifically, a central region of each of the block-shaped multiple protrusions is higher than surrounding regions.

As another specific embodiment of the present disclosure, a light emitting surface of the lens main body is a convex curved surface.

More specifically, a grid structure is arranged or integrally formed on the light emitting surface.

Further, a single grid unit in the grid structure is a convex curved surface, a concave curved surface or a plane.

Further, the single grid unit in the grid structure is rectangular, square, triangular or polygonal.

As another specific embodiment of the present disclosure, the light-entering surface is a plane or a convex curved surface.

In another aspect, the present disclosure provides a vehicle illuminator in which a light propagation path is formed, and includes a light source, a primary optical element and a lens, wherein the lens is the lens for forming the beam pattern in the low-beam zone III according to any one of the above technical solutions.

As a specific structure form of the present disclosure, the primary optical element is of a condenser structure or a reflector structure.

As another specific structure form of the present disclosure, the light source is an LED light source.

Further, the present disclosure provides an automobile which includes the vehicle illuminator according to any one of the above technical solutions.

Through the above technical solutions, the lens for forming the beam pattern in the low-beam zone III includes the lens main body, the low-beam zone III formation structure is arranged or integrally formed on the light-entering surface of the lens main body, and includes the plurality of multiple protrusions protruding from the light-entering surface for diffusing light. The low-beam zone III formation structure is arranged or integrally formed on the light-entering surface of the lens for forming the beam pattern in the low-beam zone III of the present disclosure, the low-beam zone III formation structure can form the beam pattern in the low-beam zone III, and is simple and convenient to process. Meanwhile, the low-beam zone III formation structure of the lens cannot interfere with other parts easily, and the optical performance is more stable.

Other advantages of the present disclosure and the technical effects of preferential embodiments will be further illustrated in specific embodiments hereunder.

Figure 1:
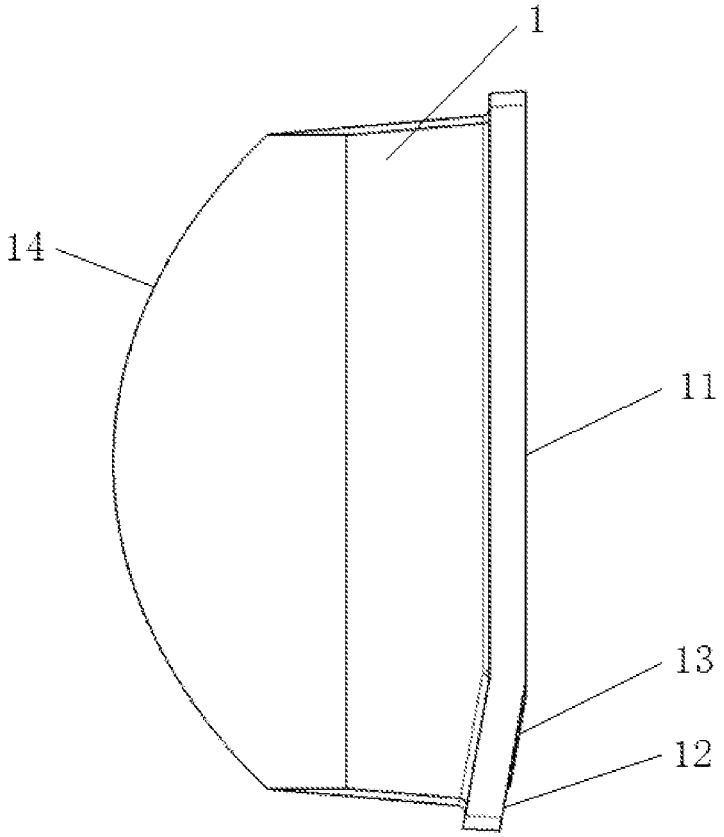
FIG. 1 is a lateral structural schematic diagram of a lens in a specific embodiment of the present disclosure.

| Brief Description of the Symbols: | |
|---|---|
| 1. lens main body | 11. upper and middle region of light-entering surface |
| 12. lower region of light-entering surface | 13. low-beam zone III formation structure |
| 13a. longitudinal strip-shaped multiple protrusions | 13b. horizontal strip-shaped multiple protrusions |
| 13c. block-shaped multiple protrusions | 14. light emitting surface |
| 15. light-entering surface | 2. primary optical element |

DETAILED DESCRIPTION OF THE EMBODIMENTS

Specific embodiments of the present disclosure will be illustrated in detail in combination with the accompanying drawings. It should be understood that the specific embodiments described herein are only for illustrating and explaining the present disclosure, rather than limiting the present disclosure.

Firstly, it should be noted that in order to clearly illustrate the technical solutions of the present disclosure in the following description, some involved orientation words such as "rear end" and "front end" have meanings analogized according to orientations indicated by a light emitting path, for example, for a lens, an end, close to a light source, of the lens is a rear end, and an end, away from the light source, of the lens is a front end; or it also can be understood that an end where light enters is the rear end, and an end where light is emitted is the front end. A light emitting direction described in the present disclosure refers to a direction in which light emitted by the light source propagates to a lens through a primary optical element, i.e., a light propagation path. In addition, in order to facilitate the following description, according to the description about the overall orientation of an automobile by engineering technicians in the automobile industry, a direction Y represents a left-right direction of an automobile in normal use, a direction X represents a front-back direction of the automobile in normal use, and a direction Z represents an up-down direction of an automobile in normal use.

In the description of the present disclosure, it should be noted that unless otherwise definitely specified and defined, terms "installation" and "connection" should be interpreted in a broad sense, for example, the connection can be fixed connection, detachable connection or integral connection, may also be direct connection, or indirect connection by an inter-medium, and can be internal connection of two elements or interaction of the two elements. Those of ordinary skill in the art can understand the specific meanings of the above terms in the present disclosure based on specific situations.

As shown in FIG. 1, FIG. 2, FIGS. 13-23, a lens for forming a beam pattern in a low-beam zone III includes a lens main body 1, wherein a low-beam zone III formation structure 13 is arranged or integrally formed on a light-entering surface 15 of the lens main body 1 and includes a plurality of multiple protrusions protruding from the light-entering surface 15 for diffusing light. The low-beam zone III formation structure 13 is arranged or integrally formed on the lens of the present disclosure, and is located at any position of the light-entering surface 15, and is mainly used for forming the beam pattern in the low-beam zone III which is continuous and uniform and has illuminance conforming to regulatory requirements.

Figure 2:
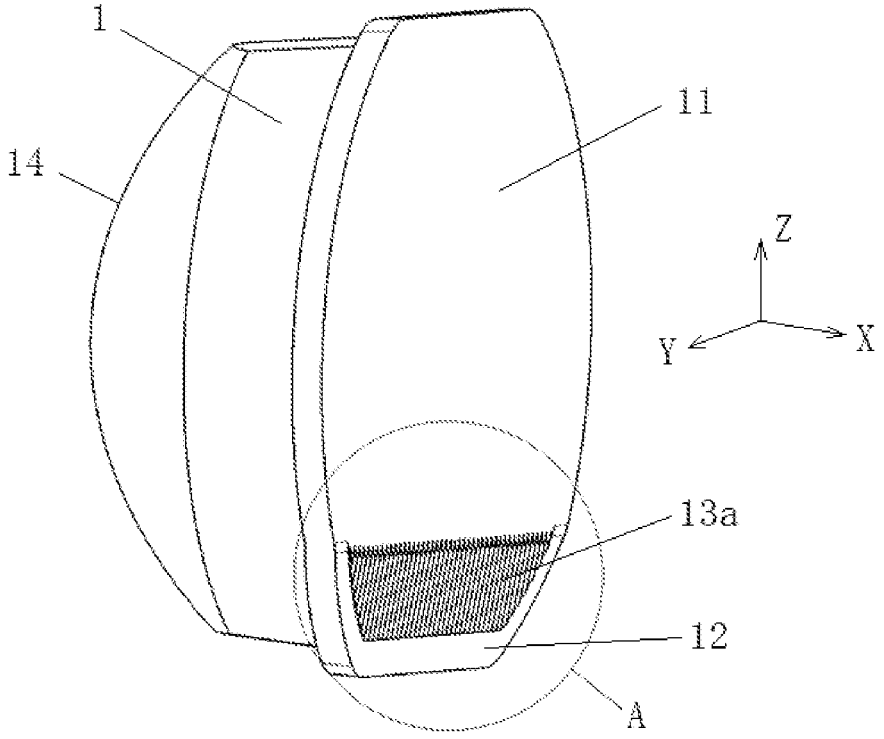
FIG. 2 is a three-dimensional structural schematic diagram of a lens in a specific embodiment of the present disclosure.

Further, as shown in FIG. 1 and FIG. 2, an upper and middle region 11 of the light-entering surface of the lens main body 1 is a plane in an up-down direction Z, a lower region 12 of the light-entering surface of the lens main body 1 is a plane inclining toward a light emitting direction from top to bottom, a low-beam zone III formation structure 13 is arranged or integrally formed on the lower region 12 of the light-entering surface, and includes a plurality of multiple protrusions protruding from the lower region 12 of the light-entering surface for diffusing light. The plurality of multiple protrusions of the lower region 12 of the light-entering surface are used for diffusing light to ensure that the beam pattern in the low-beam zone III is continuous and uniform and has illuminance conforming to the regulatory requirements.

The upper and middle region 11 of the light-entering surface of the lens main body 1 is the plane arranged in the up-down direction Z, and the lower region 12 of the light-entering surface inclines toward the light emitting direction from top to bottom, and due to such a structure, light emitted to the low-beam zone III formation structure is refracted to a zone III of a low beam light shape, i.e., above a cutoff line, by a light emitting surface 14 of the lens main body 1. Meanwhile, the low-beam zone III formation structure 13 is arranged on the lower region 12 of the light-entering surface of the lens main body 1, so that light can be emitted into the lens main body 1 through the low-beam zone III formation structure 13, and is refracted by the light emitting surface 14 of the lens main body 1 to form the beam pattern in the low-beam zone III.

Figure 3:
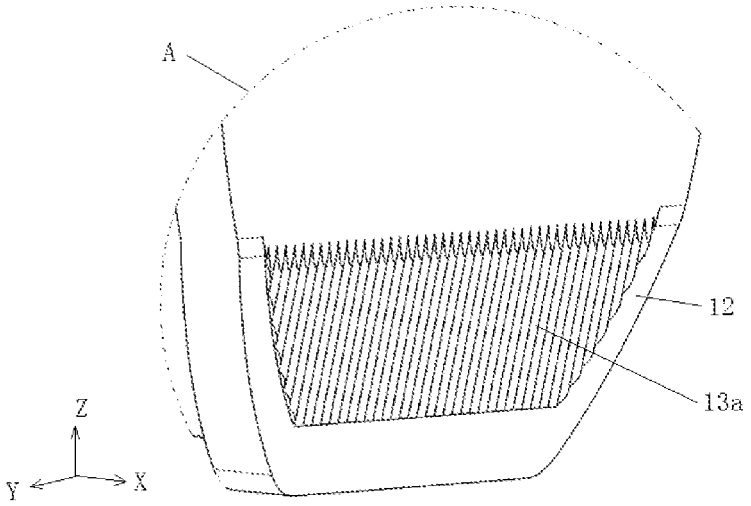
FIG. 3 is a partially enlarged structural schematic diagram of a zone III formation structure in a first specific embodiment of the present disclosure.
Figure 4:
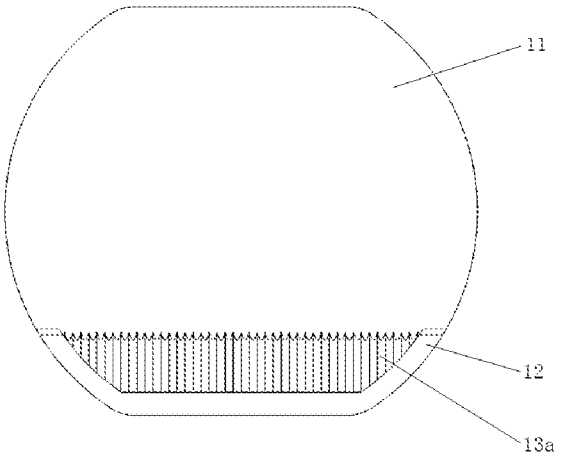
FIG. 4 is a front structural schematic diagram of a zone III formation structure in the first specific embodiment of the present disclosure.

As shown in FIG. 2-FIG. 4, as a specific embodiment of the present disclosure, the low-beam zone III formation structure 13 includes a plurality of longitudinal strip-shaped multiple protrusions 13*a* extending along the up-down direction Z of the lens main body 1.

More specifically, an outer edge of a horizontal section of each of the longitudinal strip-shaped multiple protrusions 13*a* is a convex curve of which a central region is higher than two side regions.

Further specifically, the longitudinal strip-shaped multiple protrusions 13*a* are equal in width.

Figure 11:
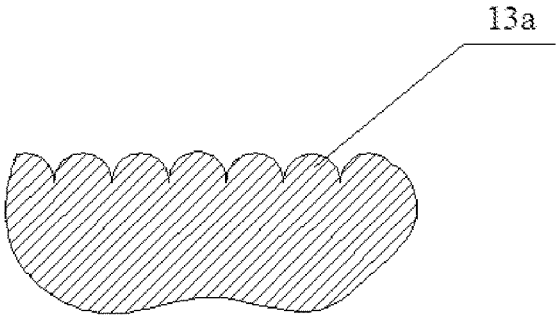
FIG. 11 is a structural schematic diagram of a horizontal section of a longitudinal strip-shaped multiple protrusions of the present disclosure.

As shown in FIG. 11, the curve of the outer edge of the horizontal section of each of the longitudinal strip-shaped multiple protrusions 13*a* has the central region higher than the two side regions, and the longitudinal strip-shaped multiple protrusions 13*a* are equal in width, and convenient for diffusing light toward a left-right direction Y.

Figure 5:
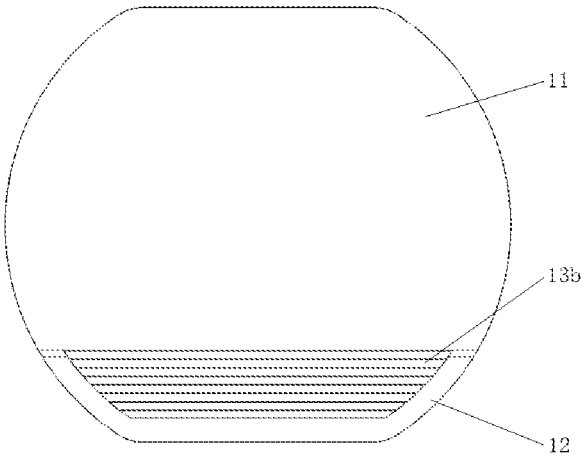
FIG. 5 is a front structural schematic diagram of a zone III formation structure in a second specific embodiment of the present disclosure.

As shown in FIG. 5, as an optional specific embodiment in specific embodiments of the present disclosure, the low-beam zone III formation structure 13 includes a plurality of horizontal strip-shaped multiple protrusions 13*b* extending along the left-right direction Y of the lens main body 1.

More specifically, an outer edge of a longitudinal section of each of the horizontal strip-shaped multiple protrusions 13*b* is a convex curve of which a central region is higher than two side regions.

Further specifically, the horizontal strip-shaped multiple protrusions 13*b* are equal in width.

Figure 12:
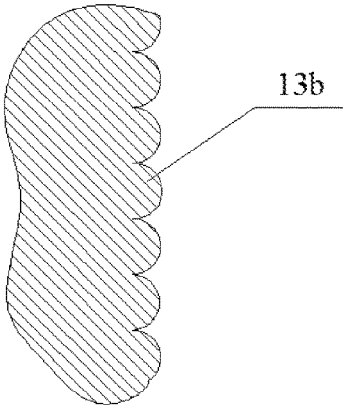
FIG. 12 is a structural schematic diagram of a longitudinal section of a horizontal strip-shaped multiple protrusions of the present disclosure.

As shown in FIG. 12, the curve of the outer edge of the longitudinal section of each of the horizontal strip-shaped multiple protrusions 13*b* has the central region higher than the two side regions, and the horizontal strip-shaped multiple protrusions 13*b* are equal in width, and convenient for diffusing light toward the up-down direction Z.

Figure 6:
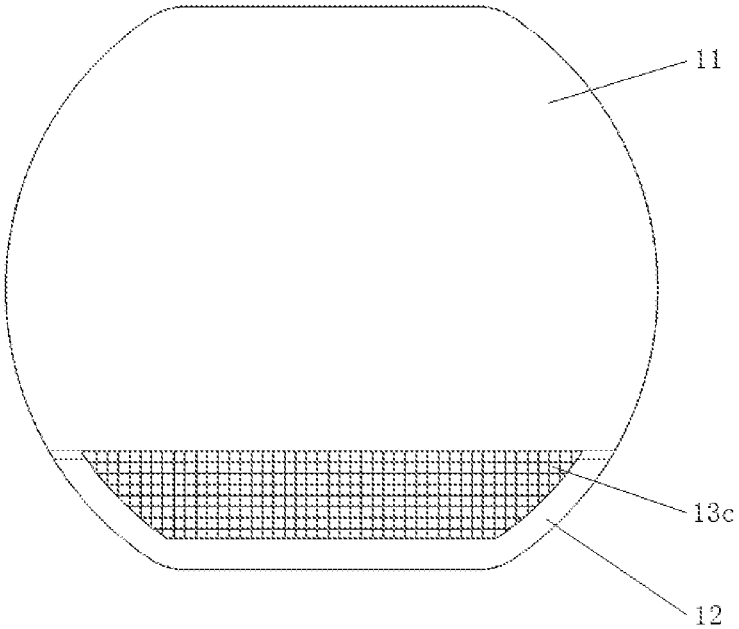
FIG. 6 is a front structural schematic diagram of a zone III formation structure in a third specific embodiment of the present disclosure.

As shown in FIG. 6, as another optional specific embodiment in the specific embodiments of the present disclosure, the low-beam zone III formation structure 13 includes a plurality of block-shaped multiple protrusions 13*c* formed by connection of convex curved surfaces.

As a specific structure form of the optional specific embodiment, a central region of each of the block-shaped multiple protrusions 13*c* is higher than surrounding regions, and the block-shaped multiple protrusions 13*c* are convenient for diffusing light all around.

In the above three specific embodiments of the present disclosure, the multiple protrusions of the low-beam zone III formation structure 13 are respectively the longitudinal strip-shaped multiple protrusions 13*a*, the horizontal strip-shaped multiple protrusions 13*b* and the block-shaped multiple protrusions 13*c*, wherein the longitudinal strip-shaped multiple protrusions 13*a* can diffuse light passing through the longitudinal strip-shaped multiple protrusions 13*a* toward the left-right direction Y, the horizontal strip-shaped multiple protrusions 13*b* can diffuse light passing through the horizontal strip-shaped multiple protrusions 13*b* toward the up-down direction Z, and the block-shaped multiple protrusions 13*c* can diffuse light passing through the block-shaped multiple protrusions 13*c* all around. However, the multiple protrusions of the low-beam zone III formation structure 13 are not limited to the three forms, and can also adopt other shapes, and specific shapes are changed according to light shape demands.

As another specific embodiment of the present disclosure, the low-beam zone III formation structure 13 includes the plurality of longitudinal strip-shaped multiple protrusions 13*a* which are arranged from a left side edge to a right side edge of the light-entering surface 15 in sequence, the plurality of longitudinal strip-shaped multiple protrusions 13*a* are connected to form a strip-shaped structure, and a longitudinal section line of the light-entering surface of each of the longitudinal strip-shaped multiple protrusions 13*a* inclines toward the light emitting direction from top to bottom.

Optionally, the low-beam zone III formation structure 13 includes a multiple protrusions structure arranged on the light-entering surface 15 and formed by connection of the plurality of longitudinal strip-shaped multiple protrusions 13*a*, the width of a horizontal section of each of the longitudinal strip-shaped multiple protrusions 13*a* is gradually decreased from middle to two sides, and a longitudinal section line of a light-entering surface of each of the longitudinal strip-shaped multiple protrusions 13*a* inclines toward the light emitting direction from top to bottom.

Figure 17:
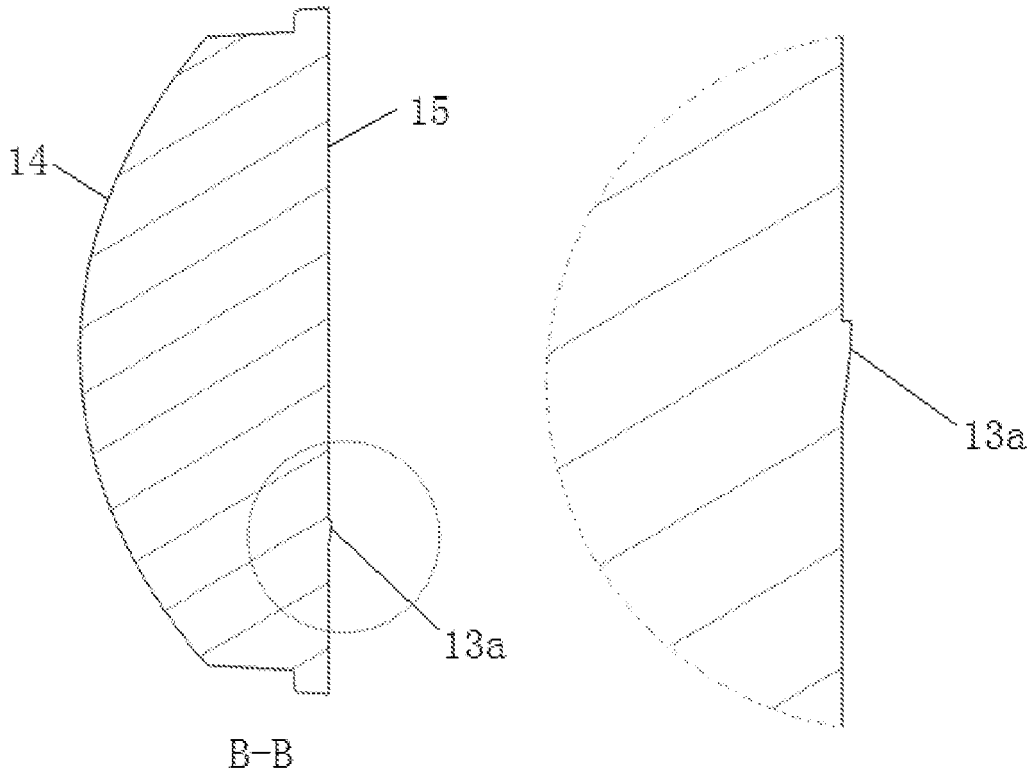
FIG. 17 is a schematic diagram of a section of FIG. 16 in a B-B direction and a partially enlarged diagram of the schematic diagram of the section
Figure 18:
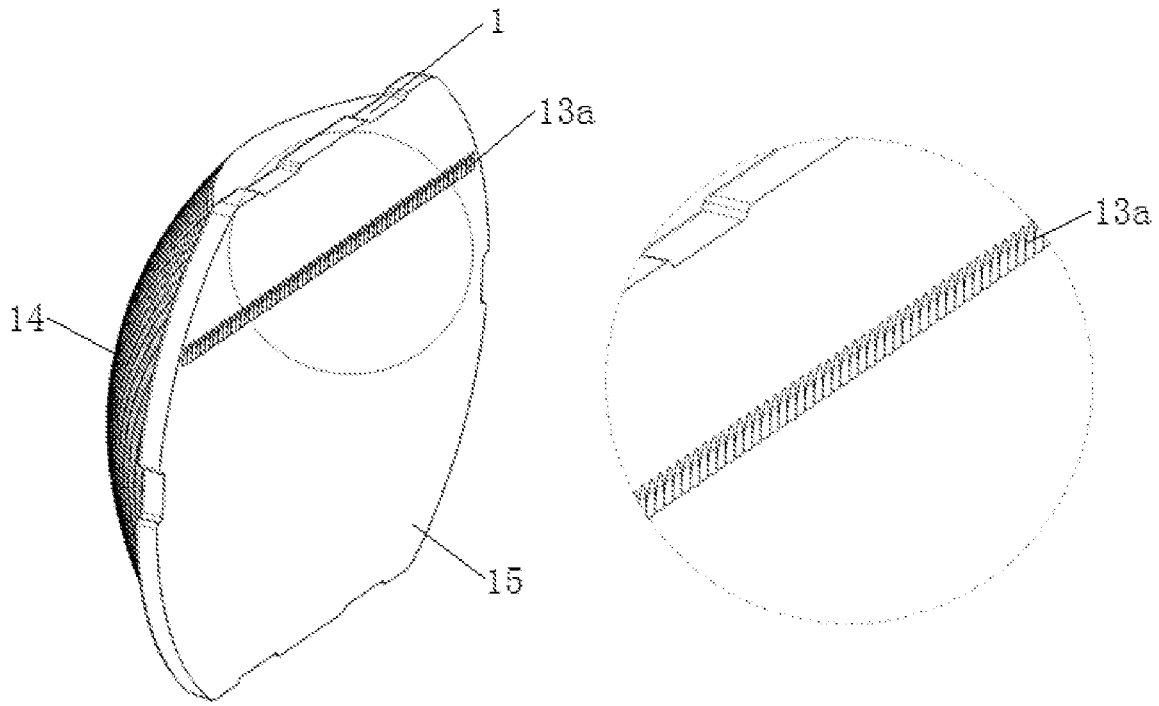
FIG. 18 is a structural schematic diagram of a zone III formation structure in a fifth specific embodiment of the present disclosure.
Figure 19:
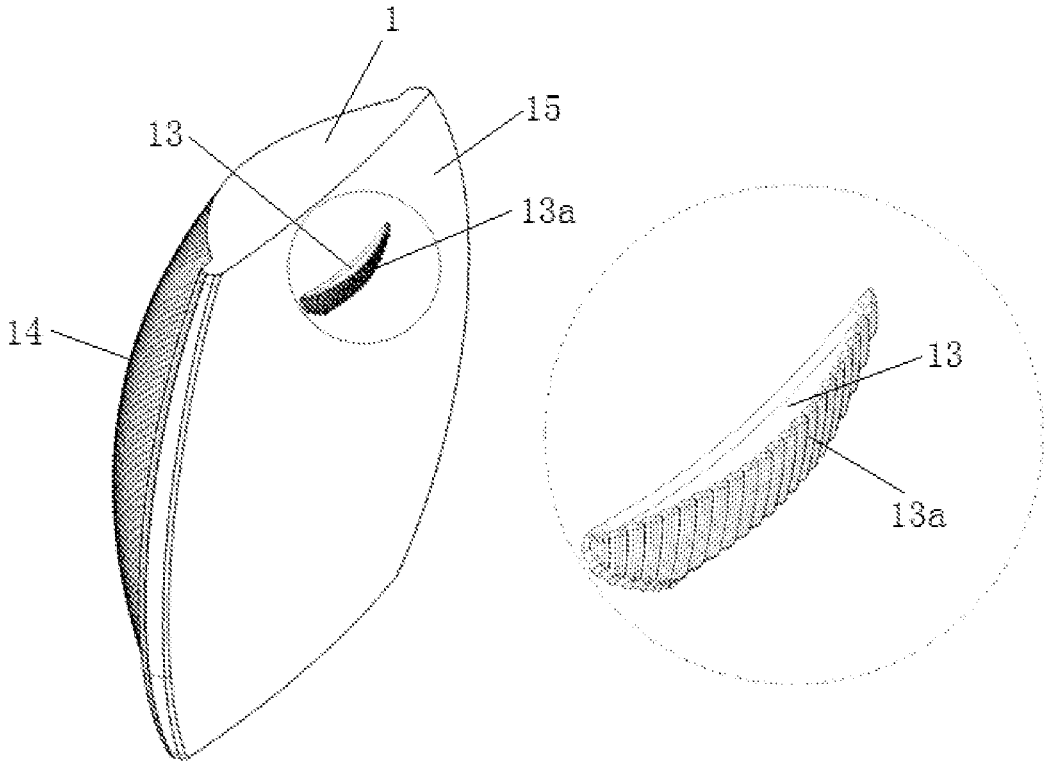
FIG. 19 is a structural schematic diagram of a zone III formation structure in a sixth specific embodiment of the present disclosure.
Figure 20:
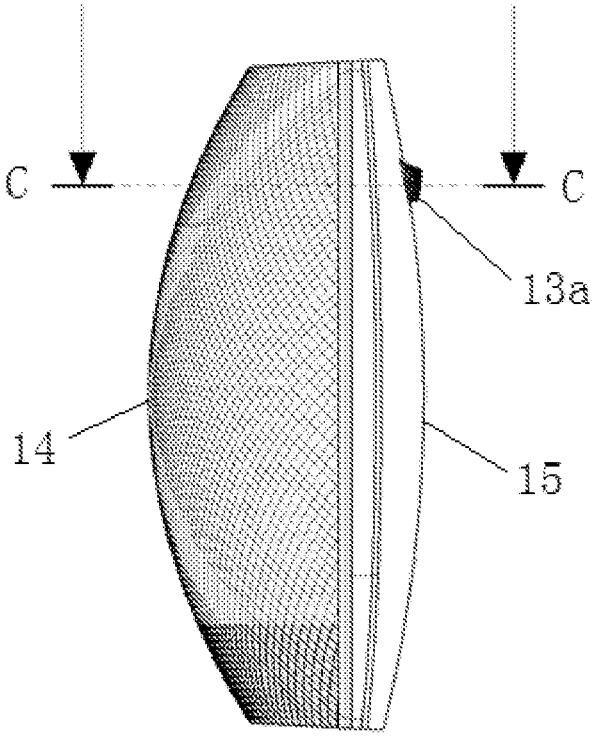
FIG. 20 is a side view of a zone III formation structure in a sixth specific embodiment of the present disclosure.
Figure 21:
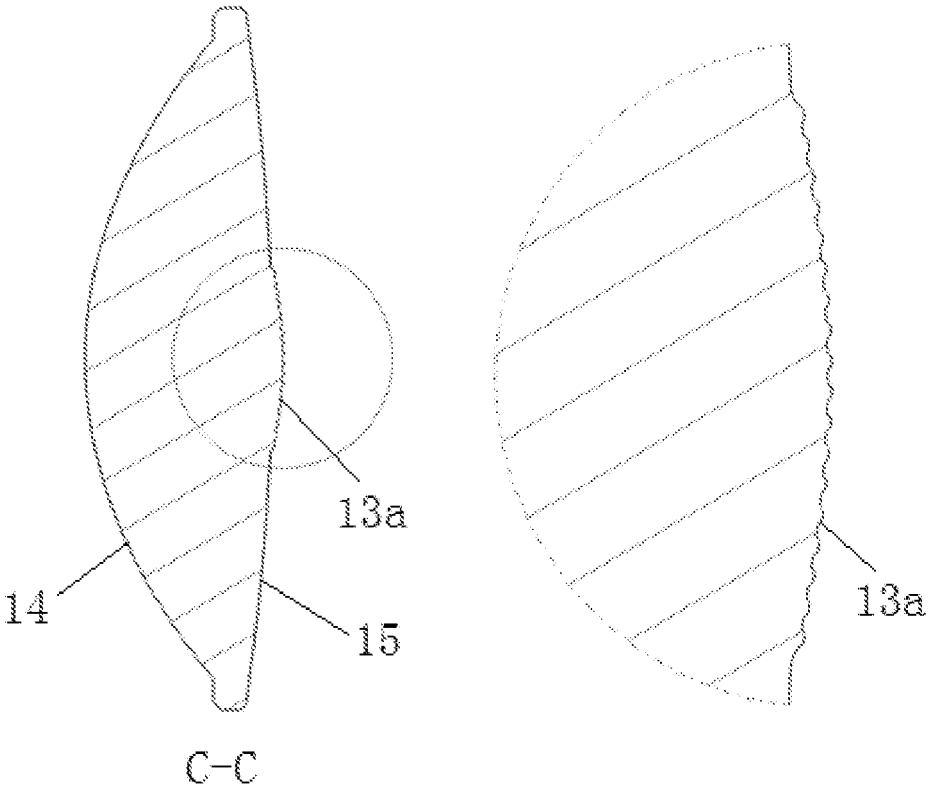
FIG. 21 is a schematic diagram of a section of FIG. 20 in a C-C direction and a partially enlarged diagram of the schematic diagram of the section.
Figure 22:
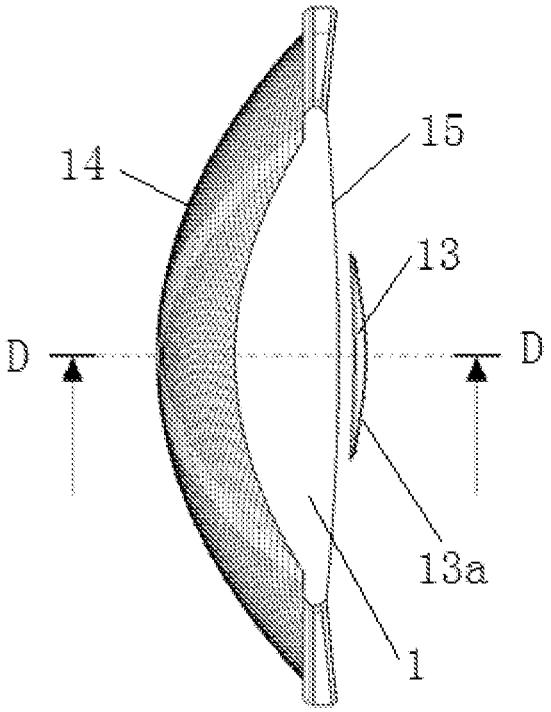
FIG. 22 is a top view of a zone III formation structure in a sixth specific embodiment of the present disclosure.
Figure 23:
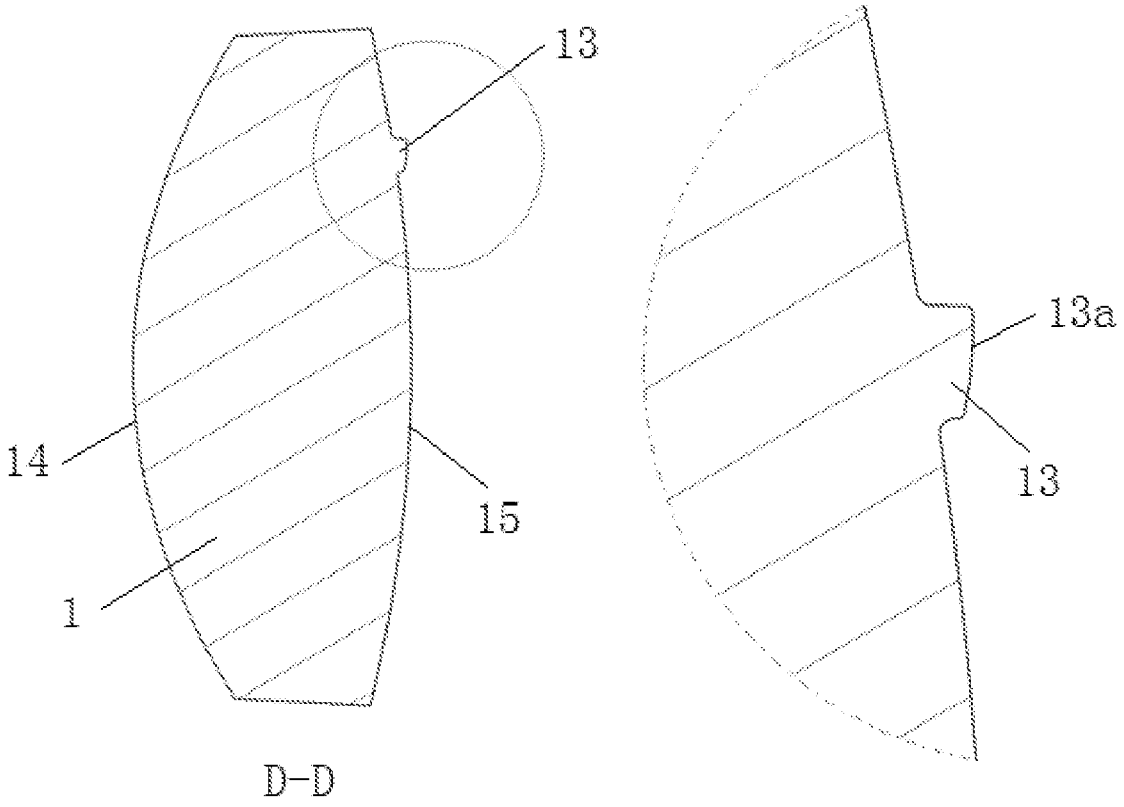
FIG. 23 is a schematic diagram of a section of FIG. 22 in a D-D direction and a partially enlarged diagram of the schematic diagram of the section.

As shown in FIG. 2-FIG. 6, the low-beam zone III formation structure 13 is a multiple protrusions structure completely covering the lower region 12 of the light-entering surface of the lens main body 1. From FIG. 13 and FIG. 18, it can be seen that the low-beam zone III formation structure 13 can be a plurality of longitudinal strip-shaped multiple protrusions 13*a* arranged from the left side edge to the right side edge of the light-entering surface 15, the longitudinal strip-shaped multiple protrusions 13*a* are connected to form a strip-shaped structure, and in order to meet light distribution requirements of the beam pattern in the low-beam zone III, as shown in FIG. 17, a longitudinal section line of a light-entering surface of each of the longitudinal strip-shaped multiple protrusions 13*a* inclines toward the light emitting direction from top to bottom. It can be seen from FIG. 19 and FIG. 22 that the low-beam zone III formation structure 13 may also be a multiple protrusions structure formed by connection of the plurality of longitudinal strip-shaped multiple protrusions 13*a* and arranged on the light-entering surface 15, the position and form of the multiple protrusions structure can be designed according to actual formation demands of the beam pattern in the low-beam zone III, for example, the multiple protrusions structure shown in FIG. 19 is positioned in the middle of an upper part of the light-entering surface 15, the length of each of the longitudinal strip-shaped multiple protrusions 13*a* is gradually decreased from middle to two sides; and similarly, as shown in FIG. 20, the longitudinal section line of the light-entering surface of each of the longitudinal strip-shaped multiple protrusions 13*a* inclines toward the light emitting direction from top to bottom to meet the light distribution requirements of the beam pattern in the low-beam zone III. Of course, the multiple protrusions in the above FIG. 13, FIG. 18 and FIG. 19 can adopt the horizontal strip-shaped multiple protrusions 13*b* or the block-shaped multiple protrusions 13*c*, or other structure forms.

Figure 13:
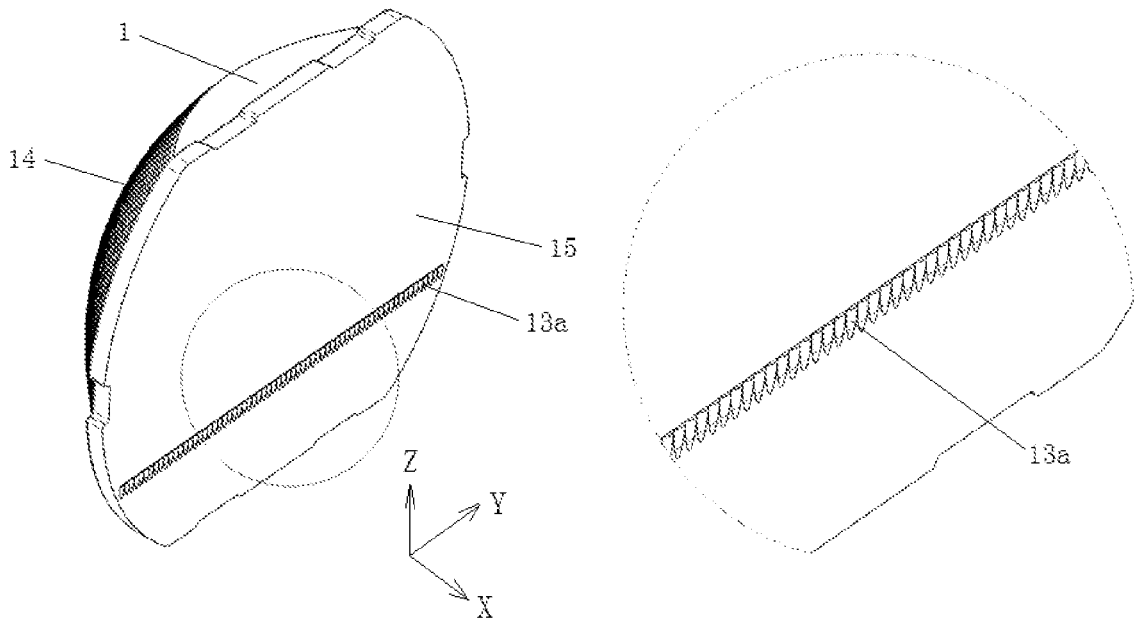
FIG. 13 is a structural schematic diagram of a zone III formation structure in a fourth specific embodiment of the present disclosure.
Figure 14:
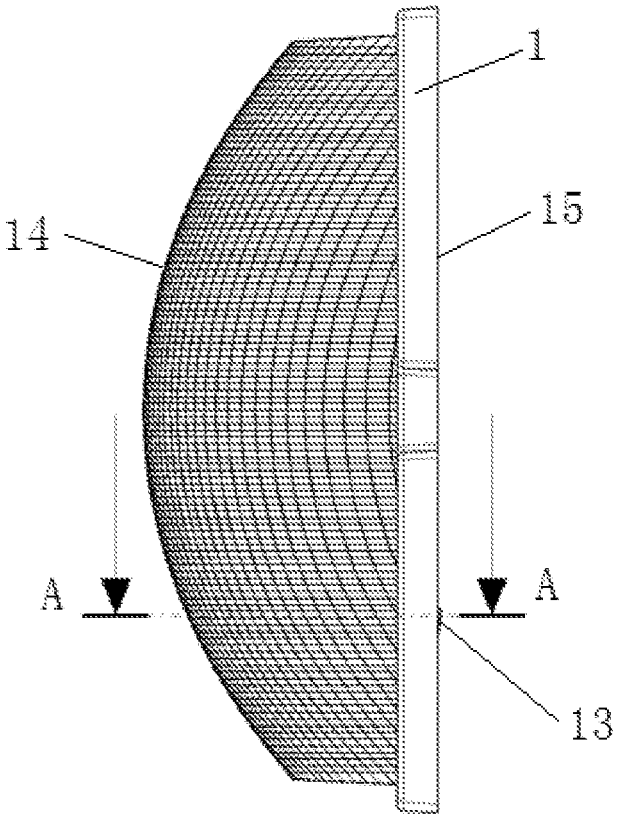
FIG. 14 is a side view of a zone III formation structure in a fourth specific embodiment of the present disclosure.
Figure 15:
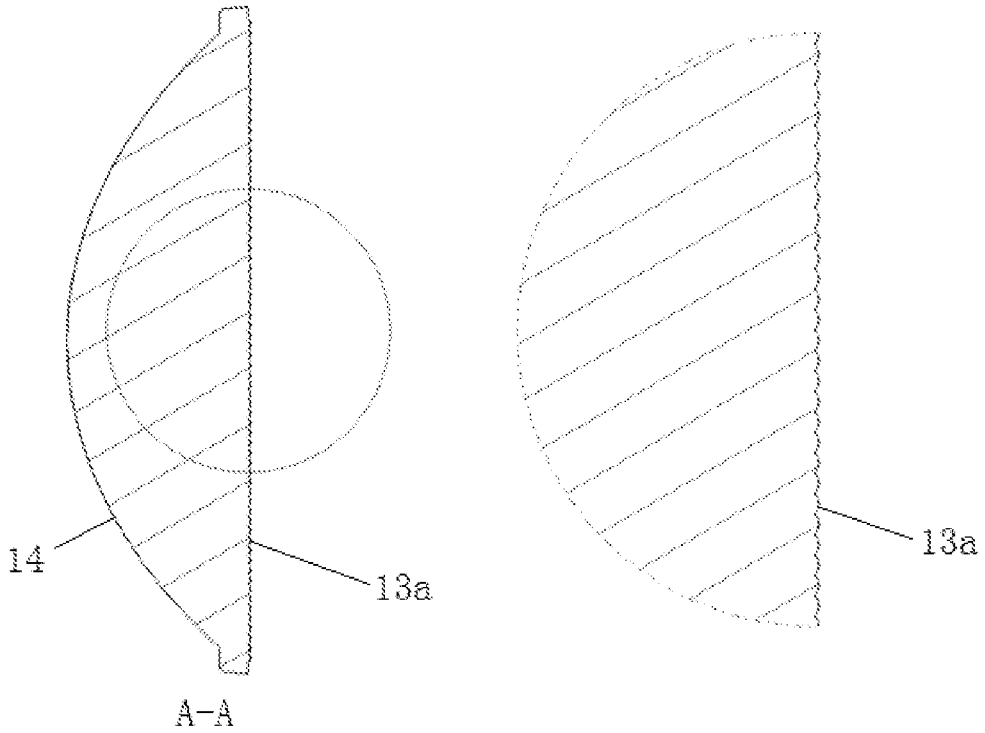
FIG. 15 is a schematic diagram of a section of FIG. 14 in an A-A direction and a partially enlarged diagram of the schematic diagram of the section.
Figure 16:
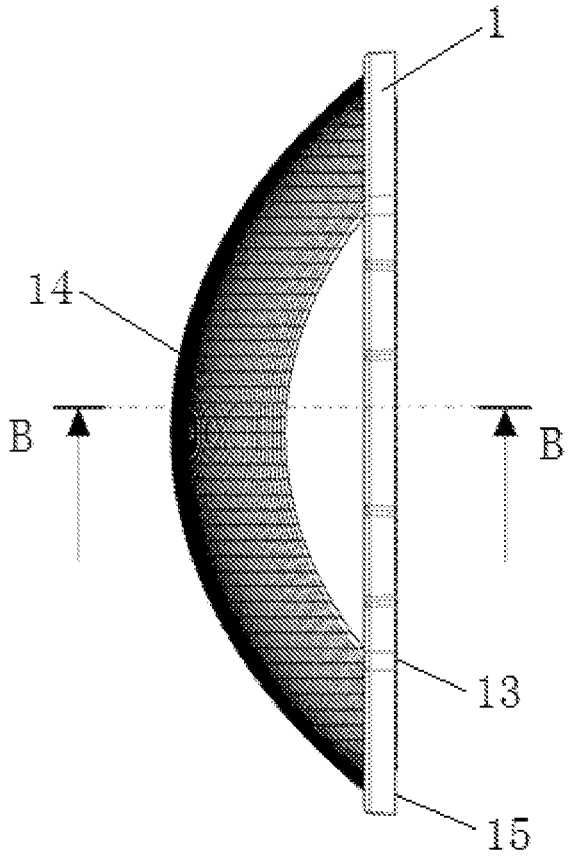
FIG. 16 is a top view of a zone III formation structure in a fourth specific embodiment of the present disclosure.

As shown in FIG. 13, the low-beam zone III formation structure 13 is formed at a lower part of the light-entering surface 15, wherein the light-entering surface 15 is a plane in the up-down direction Z; as shown in FIG. 14-FIG. 23, the low-beam zone III formation structure 13 is formed at the upper part of the light-entering surface 15, the light-entering surface 15 is also a plane in the up-down direction Z, and changes of a position of the low-beam zone III formation structure 13 on the light-entering surface 15 cannot affect the formation of the beam pattern in the low-beam zone III, so that the low-beam zone III formation structure 13 can be arranged at any position of the light-entering surface 15 according to actual demands, as long as the low-beam zone III formation structure 13 adopting various structure forms capable of conforming to low-beam zone III light distribution requirements can emit light passing through the low-beam zone III formation structure 13 into the lens main body 1, and then makes the light refracted through the light emitting surface 14 of the lens main body 1 to form the beam pattern in the low-beam zone III.

As another specific structure form of the present disclosure, the light emitting surface 14 of the lens main body 1 is a convex curved surface.

As another specific embodiment of the present disclosure, a grid structure is arranged or integrally formed on the light emitting surface 14.

Further, a single grid unit in the grid structure is a convex curved surface, a concave curved surface or a plane.

Figure 24:
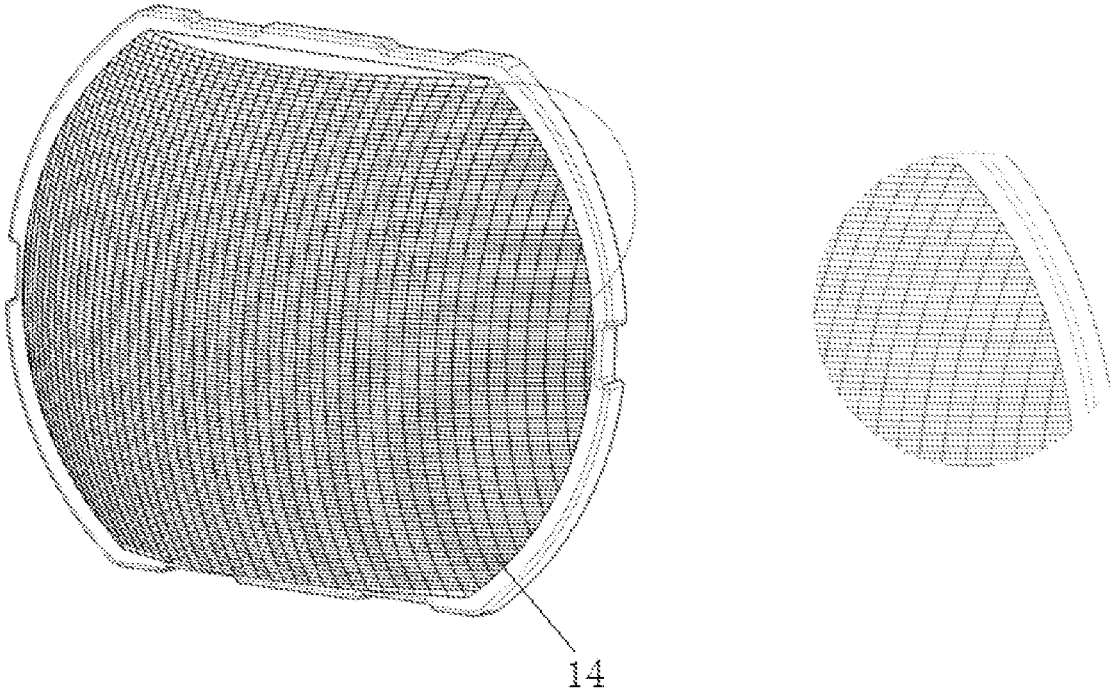
FIG. 24 is a structural schematic diagram and a partially enlarged diagram of a light emitting surface of a lens in a specific embodiment of the present disclosure.
Figure 25:
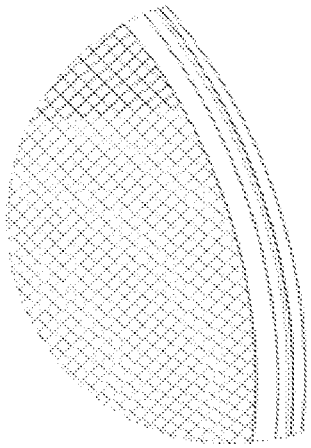
FIG. 25 is a partially enlarged diagram of a light emitting surface of a lens in another specific embodiment of the present disclosure.

More specifically, when being the plane, the single grid unit in the grid structure can be rectangular, square, triangular or polygonal, or can be in other irregular outline shapes. A grid structure shown in FIG. 24 is formed by intersection in horizontal and longitudinal directions, and a grid structure shown in FIG. 25 is formed by oblique intersection. However, the grid structure on the light emitting surface 14 is not limited to the above forms only, and can be determined based on actual light shape demands.

Obviously, the grid structure can be arranged on the light emitting surface 14 and can enlarge lighting angle and improve light shape uniformity.

As another specific embodiment of the present disclosure, the light-entering surface 15 is a plane or a convex curved surface.

As shown in FIG. 24 and FIG. 25, the light emitting surface 14 and the light-entering surface 15 are both convex curved surfaces, and the lens of the present disclosure is a biconvex lens; and if the light emitting surface 14 is the convex curved surface and the light-entering surface 15 is the plane, the lens of the present disclosure is a plano-convex lens. It should be noted herein that the lens of the present disclosure has no necessary corresponding relationship with the specific low-beam zone III formation structure 13 no matter whether the lens is the plano-convex lens or the biconvex lens, that is, the plano-convex lens and the biconvex lens can be used in combination with any low-beam zone III formation structure 13.

The present disclosure also provides a vehicle illuminator in which a light propagation path is formed. The vehicle illuminator includes a light source, a primary optical element 2 and a lens, and the lens is the lens for forming the beam pattern in the low-beam zone III according to any one of above technical solutions.

Preferentially, the primary optical element 2 is of a condenser structure or a reflector structure.

Figure 7:
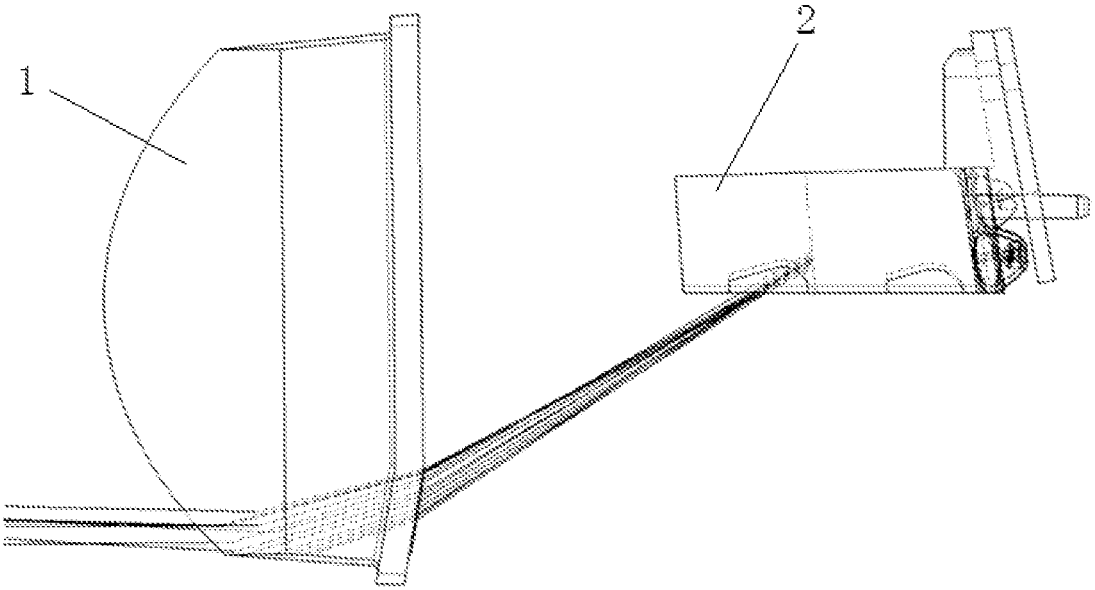
FIG. 7 is a structural schematic diagram of a vehicle illuminator in a first specific embodiment of the present disclosure.

In a specific embodiment shown in FIG. 7, the primary optical element 2 is of a condenser structure, light emitted from a light source is condensed by the primary optical element of the condenser structure, then emitted into a lens for forming the beam pattern in the low-beam zone III of the present disclosure, and refracted by the light emitting surface 14 of the lens main body 1 to form a beam pattern in a low-beam zone III.

Figure 8:
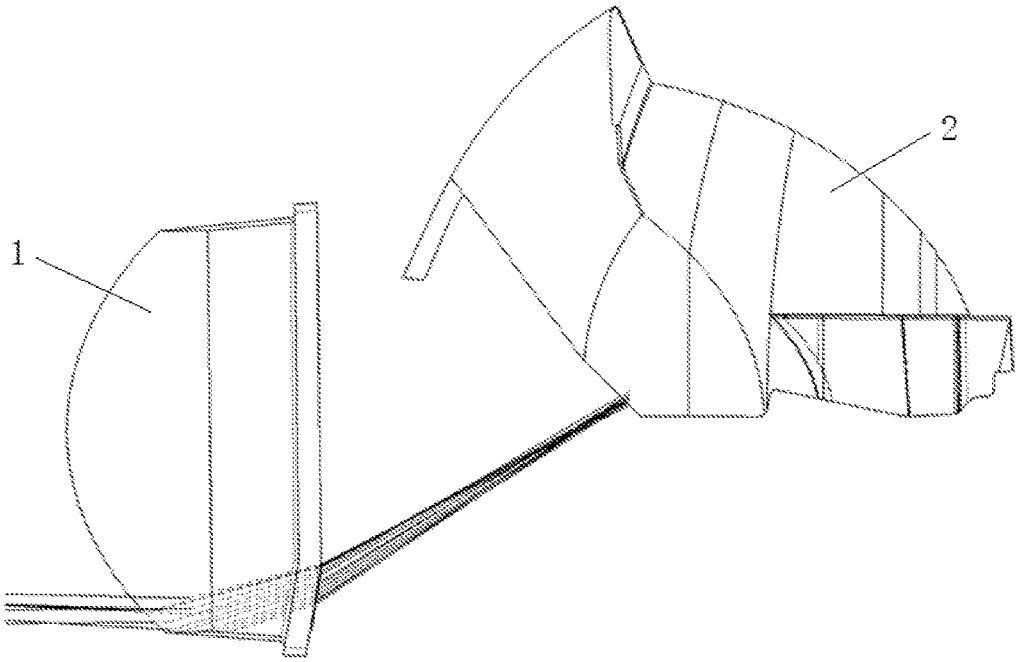
FIG. 8 is a structural schematic diagram of a vehicle illuminator in a second specific embodiment of the present disclosure.

In a specific embodiment shown in FIG. 8, the primary optical element 2 is of a reflector structure, light emitted from the light source is reflected by the primary optical element of the reflector structure, then emitted into the lens for forming the beam pattern in the low-beam zone III of the present disclosure, and refracted by the light emitting surface of the lens main body 1 to form a beam pattern in a low-beam zone III.

Two specific embodiments in FIG. 7 and FIG. 8 described above both can form the beam pattern in a low-beam zone III, and a specific selected solution is determined according to factors such as manufacturing cost and the space design of an automobile lamp module.

More preferably, the light source can be an LED light source.

The LED light source, as a new energy source, gradually replaces traditional light sources, is not only energy efficient and environmentally friendly, but also long in service life, high in brightness, stable in performance and high in luminescence purity, so that the vehicle illuminator designed based on the LED light source has broad development prospect.

It should be noted herein that the light source of the present disclosure adopts the LED light source, which does not mean that the light source is only limited to the LED light source, and the use of a laser light source or other similar light sources is regarded as an equivalent replacement.

Figure 9:
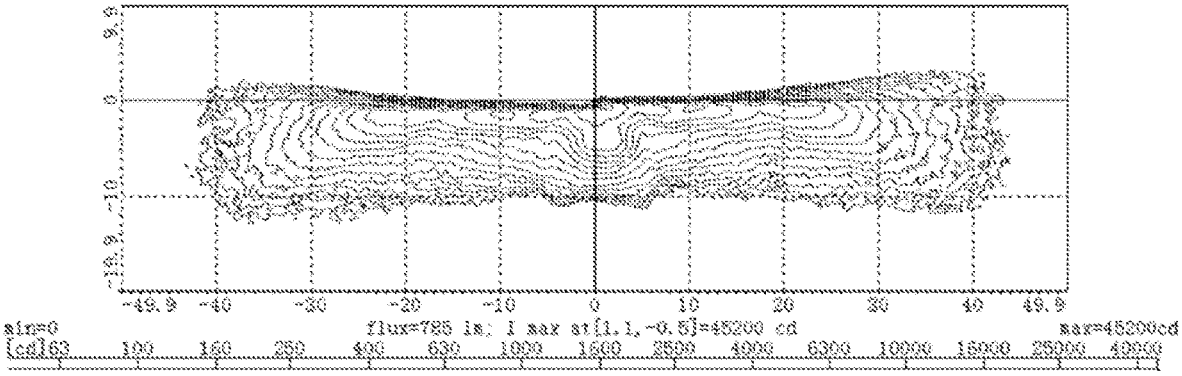
FIG. 9 is a light shape diagram in the absence of a low-beam zone III formation structure.
Figure 10:
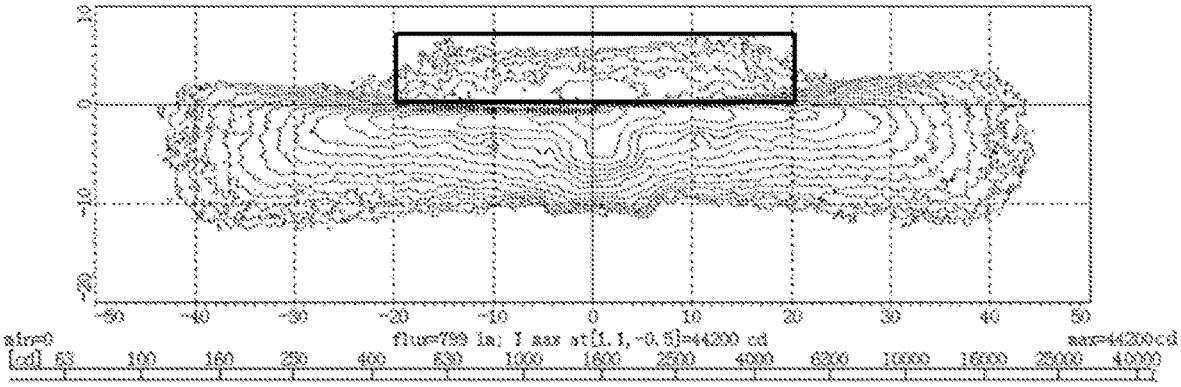
FIG. 10 is a light shape diagram in the presence of a low-beam zone III formation structure of the present disclosure.

FIG. 9 is a light shape diagram in the absence of a low-beam zone III formation structure, and FIG. 10 is a light shape diagram in the presence of a low-beam zone III formation structure. In the light shape diagram shown in FIG. 10, light emitted by the LED light source is emitted into the lens for forming the beam pattern in the low-beam zone III after passing through the primary optical element 2, and is refracted by the light emitting surface 14 of the lens main body 1 to form the beam pattern in the low-beam zone III. In order to analyze the beam pattern in the low-beam zone III diagram in the vehicle illuminator, a light distribution screen needs to be arranged in the vehicle illuminator and is a vertical screen arranged at a position 25 m in front of an automobile. By comparing and analyzing beam pattern in a low-beam zone IIIs projected on the light distribution screen, it can be seen from the figures that the beam pattern in the low-beam zone III shown in FIG. 10 is a partial light shape above the cutoff line, i.e., a light shape selected in a box in the figure; and for the light shape diagram in the absence of the low-beam zone III formation structure 13 in FIG. 9, no beam pattern in a low-beam zone III is not formed on the light distribution screen. In addition, the low-beam zone III formation structure 13 is arranged on the light-entering surface 15 of the lens main body 1, is more compact, cannot interfere with other parts easily and cannot increase the manufacturing cost.

Further, the present disclosure also provides an automobile which includes the vehicle illuminator in any one of the above technical solutions.

It can be seen from the above description that the lens for forming the beam pattern in the low-beam zone III of the present disclosure includes the lens main body 1, wherein the low-beam zone III formation structure 13 is arranged or integrally formed on the light-entering surface 15 of the lens main body 1, and includes the plurality of multiple protrusions protruding from the light-entering surface 15 for diffusing light. The low-beam zone III formation structure 13 is arranged or integrally formed on the light-entering surface 15 of the lens for forming the beam pattern in the low-beam zone III, can form the beam pattern in the low-beam zone III, is arranged on the light-entering surface 15 of the lens main body 1, and is simple and convenient to process. Meanwhile, the low-beam zone III formation structure 13 of the lens cannot interfere with other parts easily, and thus is more stable in optical performance.

The preferential embodiments of the present disclosure are described above in detail in combination with the accompanying drawings, but the present disclosure is not limited to the specific details in the above embodiments, various simple modifications can be made to the technical solutions of the present disclosure within the scope of the technical concept of the present disclosure, and these simple modifications fall within the scope of protection of the present disclosure.

In addition, it should be noted that the various specific technical features described in the above specific embodiments can be combined in any appropriate manners in the case of no confliction. In order to avoid unnecessary repetition, various possible combinations are not described separately in the present disclosure.

Furthermore, the various embodiments of the present disclosure can also be combined optionally, and should be regarded as the content disclosed in the present disclosure as long as the concept of the present disclosure is not violated.

The invention claimed is:

1. A lens for forming a beam pattern in a low-beam zone III, comprising a lens main body, wherein an upper and middle region of the light-entering surface of the lens main body is a plane in the up-down direction (Z), a lower region of the light-entering surface of the lens main body is a plane inclining toward a light emitting direction from top to bottom, and the low-beam zone III formation structure is arranged or integrally formed on the lower region of the light-entering surface, and the low-beam zone III comprises a plurality of multiple protrusions protruding from the light-entering surface for diffusing light.

2. The lens for forming the beam pattern in the low-beam zone III according to claim 1, wherein the low-beam zone_III formation structure comprises a plurality of longitudinal strip-shaped multiple protrusions extending along an up-down direction (Z) of the lens main body; or the low-beam zone III formation structure comprises a plurality of horizontal strip-shaped multiple protrusions extending along a left-right direction (Y) of the lens main body; or the low-beam zone III formation structure comprises a plurality of block-shaped multiple protrusions formed by connection of convex curved surfaces.

3. The lens for forming the beam pattern in the low-beam zone III according to claim 2, wherein the low-beam zone III formation structure comprises the plurality of longitudinal strip-shaped multiple protrusions arranged from a left side edge to a right side edge of the light-entering surface in sequence, the longitudinal strip-shaped multiple protrusions are connected to form a strip-shaped structure, and a longitudinal section line of a light-entering surface of each of the longitudinal strip-shaped multiple protrusions inclines toward the light emitting direction from top to bottom; or the low-beam zone III formation structure comprises a multiple protrusions structure arranged on the light-entering surface and formed by connection of the plurality of longitudinal strip-shaped multiple protrusions, the width of a horizontal section of each of the longitudinal strip-shaped multiple protrusions is gradually decreased from middle to two sides, and the longitudinal section line of the light-entering surface of each of the longitudinal strip-shaped multiple protrusions inclines toward the light emitting direction from top to bottom.

4. The lens for forming the beam pattern in the low-beam zone III according to claim 2, wherein an outer edge of a horizontal section of each of the longitudinal strip-shaped multiple protrusions is a convex curve of which a central region is higher than two side regions, and an outer edge of a longitudinal section of each of the horizontal strip-shaped multiple protrusions is a convex curve of which a central region is higher than two side regions.

5. The lens for forming the beam pattern in the low-beam zone III according to claim 2, wherein the longitudinal strip-shaped multiple protrusions are equal in width, and the horizontal strip-shaped multiple protrusions are equal in width, and a central region of each of the block-shaped multiple protrusions is higher than surrounding regions.

6. The lens for forming the beam pattern in the low-beam zone III according to claim 1, wherein a light emitting surface of the lens main body is a convex curved surface, and a grid structure is arranged or integrally formed on the light emitting surface.

7. The lens for forming the beam pattern in the low-beam zone III according to claim 6, wherein a single grid unit in the grid structure is a convex curved surface, a concave curved surface or a plane, and the single grid unit in the grid structure is rectangular, square, triangular or polygonal.

8. A vehicle illuminator, wherein a light propagation path is formed in the vehicle illuminator, the vehicle illuminator comprises a light source, a primary optical element and a lens, and the lens is the lens forming the beam pattern in the low-beam zone III according to claim 1.

9. The vehicle illuminator according to claim 8, wherein the primary optical element is of a condenser structure or a reflector structure.

10. An automobile, comprising the vehicle illuminator according to claim 8.

11. The automobile according to claim 10, wherein the low-beam zone III formation structure comprises a plurality of longitudinal strip-shaped multiple protrusions extending along an up-down direction (Z) of the lens main body; or the low-beam zone III formation structure comprises a plurality of horizontal strip-shaped multiple protrusions extending along a left-right direction (Y) of the lens main body; or the low-beam zone III formation structure comprises a plurality of block-shaped multiple protrusions formed by connection of convex curved surfaces.

12. The vehicle illuminator according to claim 8, wherein the low-beam zone III formation structure comprises a plurality of longitudinal strip-shaped multiple protrusions extending along an up-down direction (Z) of the lens main body; or the low-beam zone III formation structure comprises a plurality of horizontal strip-shaped multiple protrusions extending along a left-right direction (Y) of the lens main body; or the low-beam zone III formation structure comprises a plurality of block-shaped multiple protrusions formed by connection of convex curved surfaces.

13. The vehicle illuminator according to claim 12, wherein the low-beam zone III formation structure comprises the plurality of longitudinal strip-shaped multiple protrusions arranged from a left side edge to a right side edge of the light-entering surface in sequence, the longitudinal strip-shaped multiple protrusions are connected to form a strip-shaped structure, and a longitudinal section line of a light-entering surface of each of the longitudinal strip-shaped multiple protrusions inclines toward the light emitting direction from top to bottom; or the low-beam zone III formation structure comprises a multiple protrusions structure arranged on the light-entering surface and formed by connection of the plurality of longitudinal strip-shaped multiple protrusions, the width of a horizontal section of each of the longitudinal strip-shaped multiple protrusions is gradually decreased from middle to two sides, and the longitudinal section line of the light-entering surface of each of the longitudinal strip-shaped multiple protrusions inclines toward the light emitting direction from top to bottom.

14. The vehicle illuminator according to claim 12, wherein an outer edge of a horizontal section of each of the longitudinal strip-shaped multiple protrusions is a convex curve of which a central region is higher than two side regions, and an outer edge of a longitudinal section of each of the horizontal strip-shaped multiple protrusions is a convex curve of which a central region is higher than two side regions.

15. The vehicle illuminator according to claim 12, wherein the longitudinal strip-shaped multiple protrusions are equal in width, the horizontal strip-shaped multiple protrusions are equal in width, and a central region of each of the block-shaped multiple protrusions is higher than surrounding regions.

16. The vehicle illuminator according to claim 8, wherein a light emitting surface of the lens main body is a convex curved surface, and a grid structure is arranged or integrally formed on the light emitting surface.

17. The vehicle illuminator according to claim 16, wherein a single grid unit in the grid structure is a convex curved surface, a concave curved surface or a plane, and the single grid unit in the grid structure is rectangular, square, triangular or polygonal.

* * * * *